US006250021B1

(12) United States Patent
Ferrara, Jr.

(10) Patent No.: US 6,250,021 B1
(45) Date of Patent: Jun. 26, 2001

(54) TEMPORARY OR SEMI-PERMANENT SHELTER

(76) Inventor: Daniel A. Ferrara, Jr., 221 Looking Glass Hill Rd., Morris, CT (US) 06763

( * ) Notice: Subject to any disclaimer, the term of this patent is extended or adjusted under 35 U.S.C. 154(b) by 0 days.

(21) Appl. No.: 09/514,908

(22) Filed: Feb. 28, 2000

(51) Int. Cl.[7] ..... E04B 1/346

(52) U.S. Cl. ..... 52/71; 52/273; 52/282.3; 52/284; 52/285.4; 446/423; 446/476; 446/901

(58) Field of Search ..... 52/71, 273, 282.3, 52/284, 285.4, 66, 64, 68; 135/100, 121, 124, 128, 143; 446/423, 476, 478, 901

(56) References Cited

U.S. PATENT DOCUMENTS

| | | | | |
|---|---|---|---|---|
| 3,068,534 | * | 12/1962 | Hu . | |
| 3,139,958 | * | 7/1964 | Witt . | |
| 3,333,373 | * | 8/1967 | Taylor et al. . | |
| 3,727,355 | * | 4/1973 | Vachon | 52/82 |
| 3,996,706 | * | 12/1976 | Bomgaars | 52/71 |
| 4,073,105 | * | 2/1978 | Daugherty | 52/169.9 |
| 4,640,061 | * | 2/1987 | Trumley | 52/71 |
| 4,672,779 | * | 6/1987 | Boyd | 52/79.4 |

* cited by examiner

*Primary Examiner*—Carl D. Friedman
*Assistant Examiner*—Yvonne M. Horton
(74) *Attorney, Agent, or Firm*—Dallett Hoopes

(57) ABSTRACT

Starting from flat partly assembled components, this shelter, when erected, includes tubular roof-reinforcing and attachment beams disposed against roof segments and sidewalls.

8 Claims, 5 Drawing Sheets

TEMPORARY OR SEMI-PERMANENT SHELTER

FIELD OF THE INVENTION

This invention relates to a temporary or semi-permanent shelter erectable from folded flat components. It also relates to a roof and wall reinforcing beams for such a shelter, also erectable from flat components.

BACKGROUND OF THE INVENTION

Recent disasters—earthquakes and floods—and political mobilizations and assemblies have demonstrated the need for temporary or semi-permanent shelters. Especially needed have been shelters whose components are easily stored and readily transported and are easily erected near the site of the disaster or wherever needed. Typically, such shelters have been in the form of fabric tents.

The present invention provides a temporary or semi-permanent shelter of more substantial nature, illustratively with rugged multi-ply, laminated corrugated board walls and roof. Prior to erection, the components are flat packages. The components together take on a three-dimensional shape in assembly and afford a substantial, durable, water-proof shelter which can be readily returned to flat condition when no longer needed. The word "Temporary" is used herein to indicate what is generally thought of as not being permanent. The durability of the present shelter may belie the name.

SUMMARY OF THE INVENTION

The invention is a shelter erectable on site comprising a wall assembly including hinged-together panels folded into a flat stack adapted in assembly to form a polygonal continuous side wall structure having a plurality of side walls. It also comprises a roof assembly including a plurality of flat generally triangular roof segments adapted to be arranged and connected with a vertex of each triangle directed to the same point, the base of each triangular segment being outward from the vertex, the total of the vertices adjacent the point being less than 360° so that, when assembled, the roof comes to a peak. The roof assembly is adapted to superpose the wall assembly with the bases of the triangular roof segments resting on the upper ends of the side walls respectively.

Further, the roof assembly includes a plurality of roof and wall attachment and reinforcement beams comprising flat sheets having generally trapezoidal shapes with long sides equal to the interior width of the respective walls, each sheet presenting three spaced fold lines parallel to the long side and marked or scored at different distances from the long side to define four connected side bands. These are a first, second and third side bands and an overlapping end band: Each sheet is adapted to be folded on the marked or pre-scored lines to form a triangular tubular beam with the overlapping band adhesively secured to the inside of the first band. In a preferred form of the invention, the second band is adhesively secured to the contiguous roof segment in the pre-erected condition. The tubular beams of the roof segments together form a downward curb secured to the roof and which fits snugly inside the polygon comprising the walls attach the roof and walls together and additionally there are mechanical means to further secure the roof and walls together if desired or necessary.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
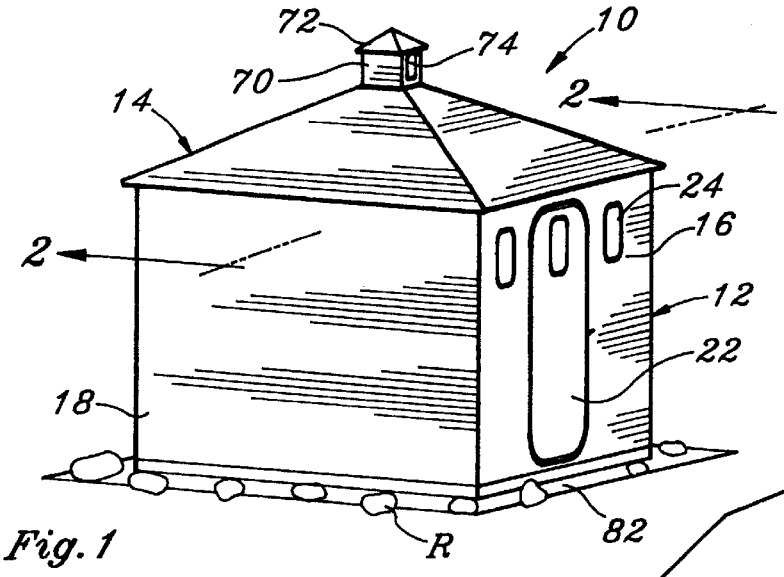
FIG. 1 is a perspective view of an erected shelter embodying the invention.
Figure 3:
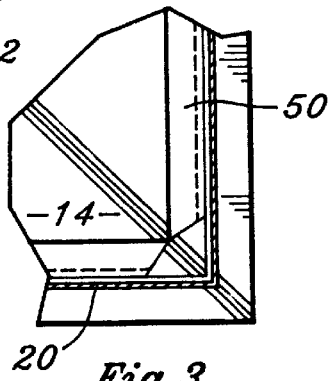
FIG. 3 is an enlarged fragmentary sectional view taken on the line 3—3 of FIG. 2.

An erected temporary shelter embodying the invention is generally designated 10 in FIG. 1. It comprises a plurality of vertical walls 12 and a pyramidal roof 14.

Figure 2:
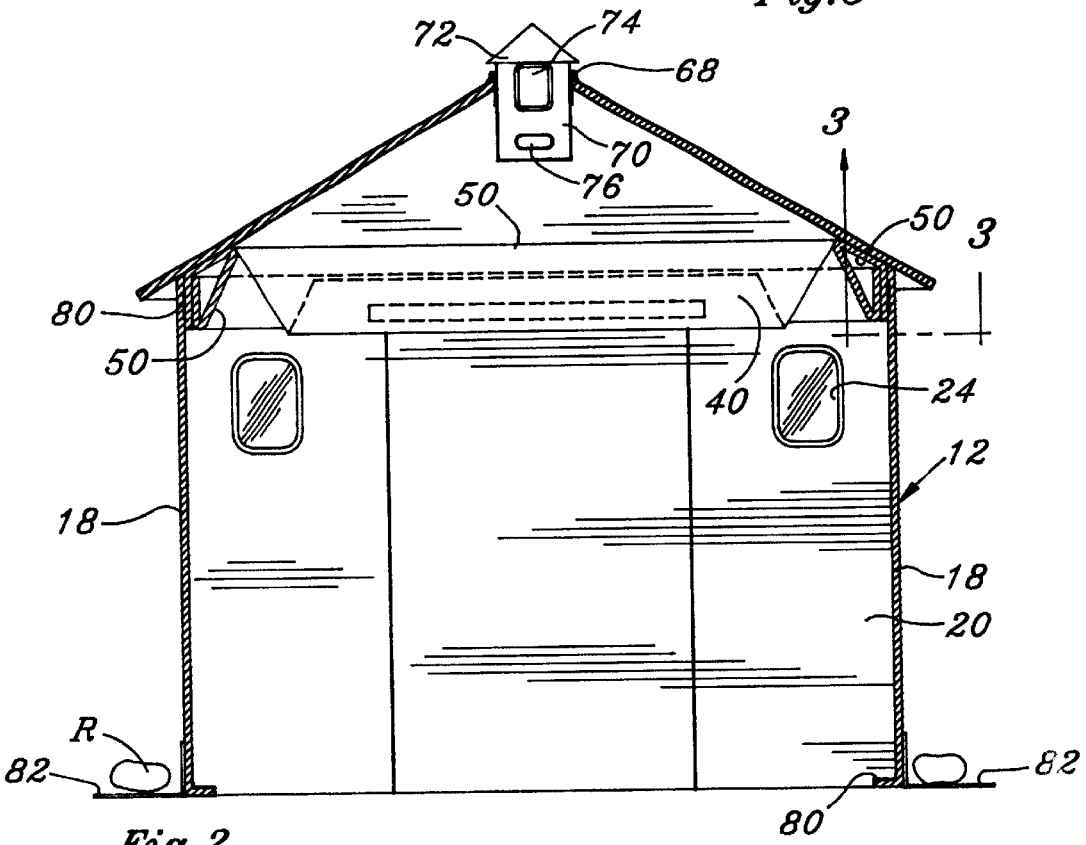
FIG. 2 is an enlarged vertical section taken on the line 2—2 of FIG. 1
Figure 11:
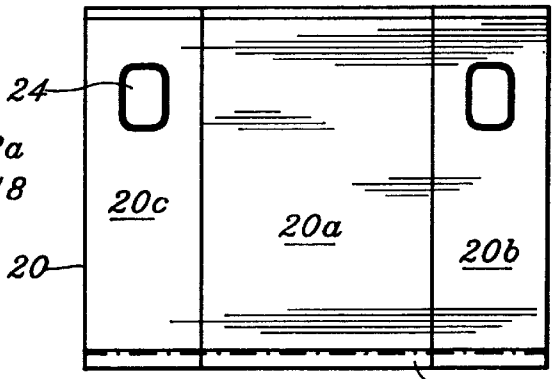
FIG. 11 is an elevational view of an erected rear wall.
Figure 10:
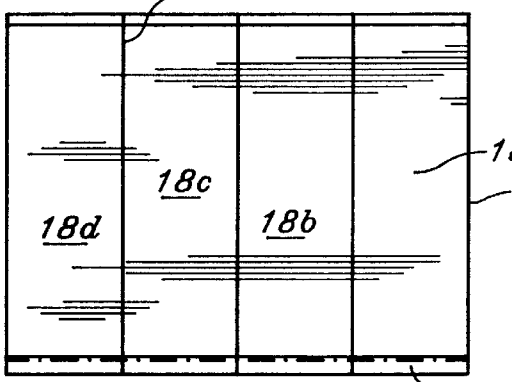
FIG. 10 is an elevational view of an erected side wall.
Figure 9:
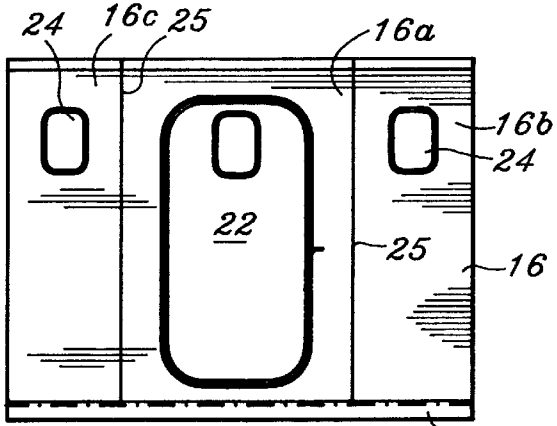
FIG. 9 is an elevational view of an erected front wall.

Referring to FIG. 2, the plurality of walls 12 comprise a connected front wall 16, side walls 18 and rear wall 20. As shown, the front wall may be provided with a hinged door 22 the rear wall 20 may be provided with spaced windows 24 secured in openings in respective panels thereof. Elevational views of the front wall 16, the side walls 18 and the rear wall 20 are shown in FIGS. 9 through 11.

Figure 12:
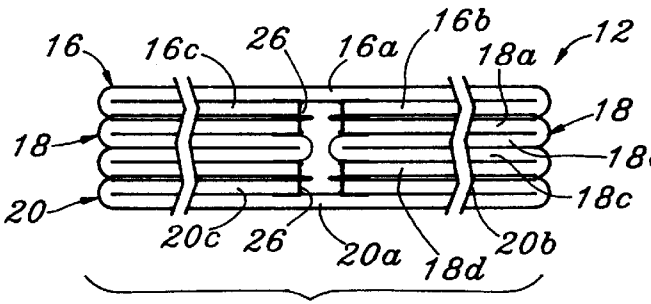
FIG. 12 is an enlarged end view, foreshortened to conserve drawing space, of the wall assembly before being erected showing the folding pattern of the wall assembly.

Before erection of the shelter the plurality of walls 12 are disposed in flat condition as shown in FIG. 12. Each wall is comprised in turn of a plurality of panels. Specifically, the front wall 16 comprises three panels 16*a*, a center section including the door 22, and side sections 16*b* and 16*c*, respectively. Between the panels the side wall is scored or otherwise provided with fold lines 25.

Side walls 18 comprise a plurality of more or less equal panels 18*a*, 18*b*, 18*c* and 18*d*. Preferably, between the panels the sheet is scored or otherwise provided with fold lines 25. The rear wall 20 (FIG. 11) is formed of a central panel 20*a* and side panels 20*b* and 20*c*, each provided with a opening closed window 24.

Figure 13:
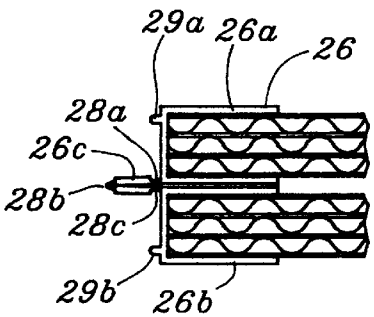
FIG. 13 is an enlarged fragmentary sectional view of a joint between walls before the wall assembly is erected.

FIG. 13 discloses the corner structure 26 in folded condition. The vertical ends of each of the walls is provide with a U-shaped plastic extruded runner 26*a* and 26*b* serving to waterproof the ends against invasion by water. The runners and 26*b* are connected by a hinge 26*c* which preferably comprises three "living hinges" 28*a*, 28*b* and 28*c* connecting the runner 26*a* and 26*b* along the length thereof. Aligning nibs 30*a* and 30*b* are provided on the bight sections of the U-shaped runners.

Figure 14:
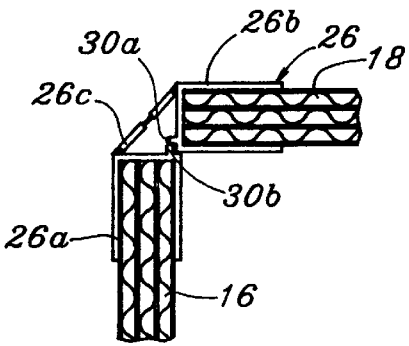
FIG. 14 is a view similar to FIG. 13 after the wall assembly is erected.

In assembly (FIG. 14), adjacent walls, illustratively the side wall 18 and the rear wall 16, are disposed at right angles with the nibs 29*a* and 29*b* engaging each other and the hinge elements 26*c* disposed straight across the opposite edges of the respective U-shaped elements 26*a* and 26*b*. Dimensions are such that the hinge elements 26 extend in a straight line, and the nibs 20*a* and 20*b* hold the U-shaped runners 26*a* and 26*b* in the shape of proper corners disposed at right angles with projections of the inside surfaces of the walls 16, 18 meeting at a point just beyond the ends of the respective walls. The hinge elements 26 thus form an effective waterproof barrier and provide a smooth chamfered outer surface of the corner structure.

Referring to FIG. 12, before erection the continuous wall structure 12 of the temporary shelter is folded flat with the various panels disposed accordion fashion. More specifically the front wall 16 may have its center panel 16*a* disposed horizontally on the upside of the package. The side panels 16*b* and 16*c* are folded inward under the central panel as shown. Under the side panels 16*b* is disposed a side wall 18 with the individual component panels 18*a*, 18*b*, 18*c* and 18*d* disposed accord fashion therebelow. The other side wall 18 is disposed in similar fashion under the side panel 16*c* of the front 16.

The rear wall 20 is disposed under the respective side panels 18*d* with the side panel 20*b* under panel 18*d* on the right hand side of FIG. 2 and the side panel 20*c* under the left hand side panel 18*d* of the offset side wall 18. Corner structures 2 as shown in FIG. 13 connect the folded front wall with the side 18 and the rear wall 20 with the side walls as shown.

When erected, the package shown in FIG. 12 provides connected side walls of generally square shape have hinged structures at each corner. The hinge portions 26 show as smooth beveled edges of the structure.

Figure 4:
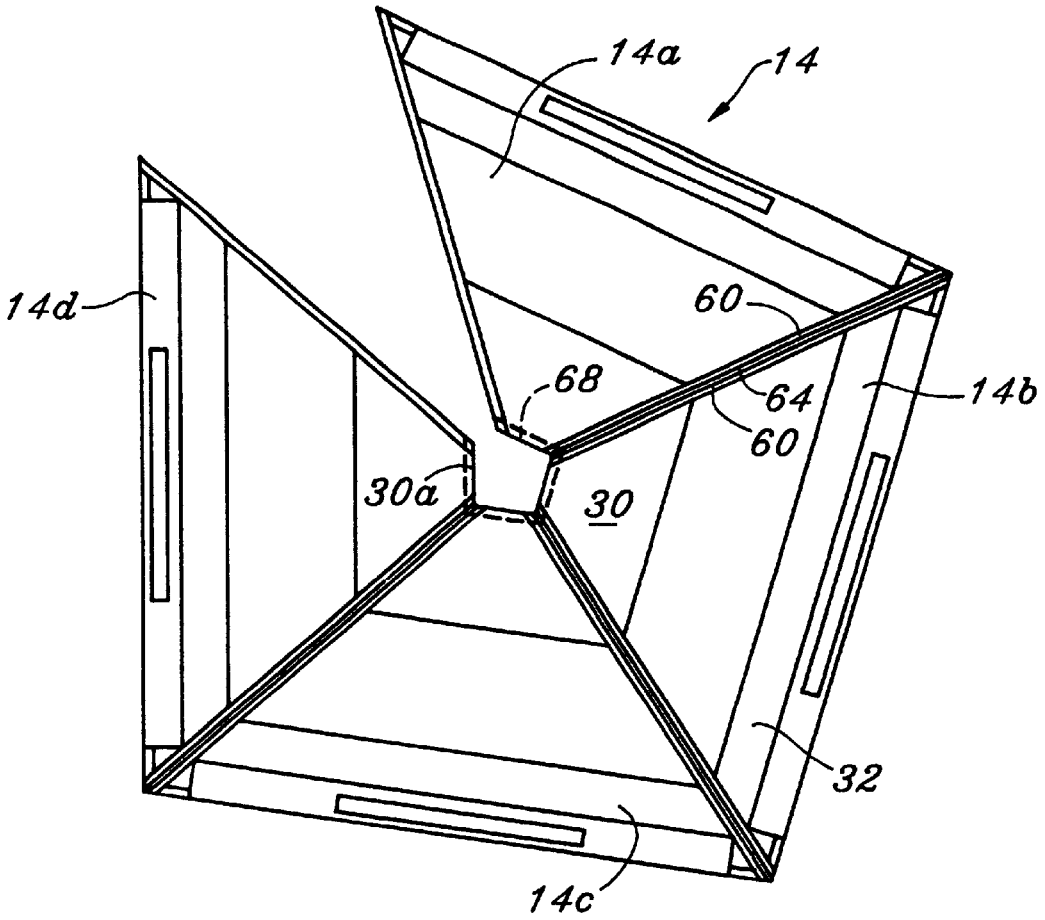
FIG. 4 is a top plan view of a roof with unfolded roof beam blanks still attached and with all but one connection between segments in place.
Figure 6:
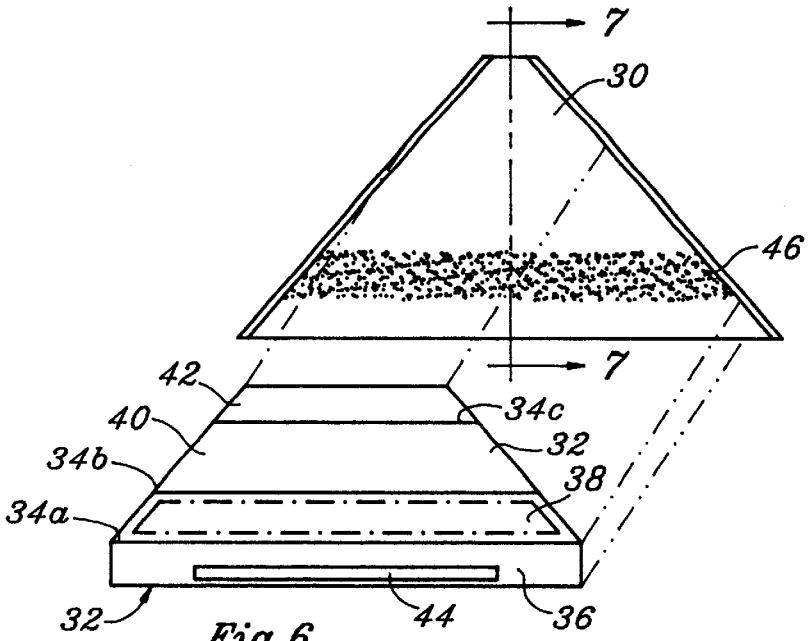
FIG. 6 is an exploded plan view of a roof segment and a roof beam blank in flat unerected condition.

Referring now to the roof structure 14, it is shown in partly assembled condition in FIG. 4. It comprises a plurality of generally triangular segments 14*a*, 14*b*, 14*c* and 14*d*, each which (FIG. 6) comprise a two-component structure including the triangular roof segment 30 and a roof beam blank 32 pre-erected and flat against the roof segment 30.

The beam blank 32 (FIG. 6) is formed with a plurality of score lines 34*a*, 34*b*, 34*c*. These divide the beam blank into four separate bands including a first band 36, a second band 38, a third band 40 and an overlapping end band 42. The first band 36 carries a peel strip 44 overlying an adhesive coating. Alternatively the attachment may be mechanically interfitting fastener parts such as snap-together extrusions, one on each of the opposing surfaces. The roof segment 30 and the second band 38 of the beam bank 32 are secured together by adhesive layer 46 holding the two components flat against each other.

Figure 7A:
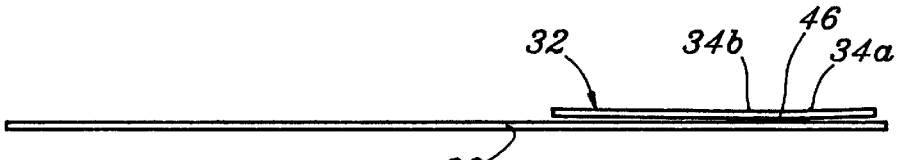
FIGS. 7*a, b* and *c* are enlarged sectional views taken on line 7—7 of FIG. 6 showing progressively the steps in erecting roof beam from a blank.

For storage and shipment, the roof segments 30 with their respective attached beam blanks 32 are flat as shown in FIG. 7*a*. These assemblies are, in the progress of the erection of the shelter, individually assembled by folding the beam blank on the fold or score lines 34*a*, 34*b* and 34*c*. In the process (FIG. 6) the first band 36 is folded up from the second band along the line 34*a*, and the third band 40 is folded up along the line 3*b*. The overlapping band 42 is similarly folded at line 34*c* with respect to the third band 40. The peel strip 44 is removed from the first band 36 and the overlapping band 42 is pressed against the first band 36 to complete the assemble of the individual roof beam 50.

Figure 7B:
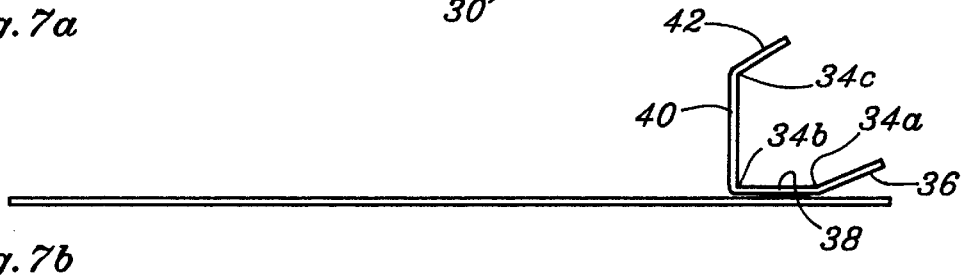
Figure 7C:
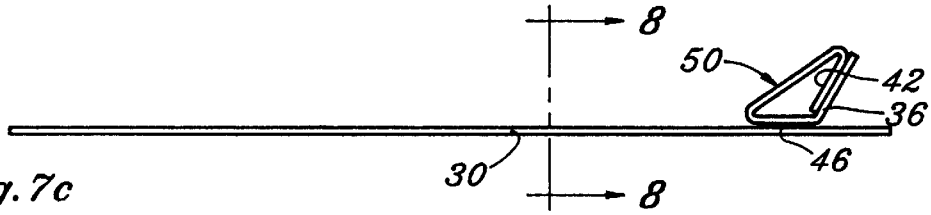
Figure 8:
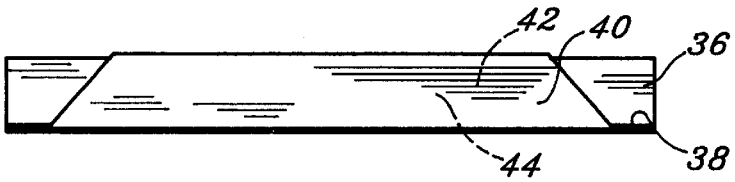
FIG. 8 is a reduced sectional view taken on the line 8—8 of FIG. 7*c;*

By design, the angle between the roof segment 30 (FIG. 7*c*) and the first band 36 is identical to the angle of the roof to the vertical walls 12 in the assembled structure, for each of the walls, respectively.

Figure 5:
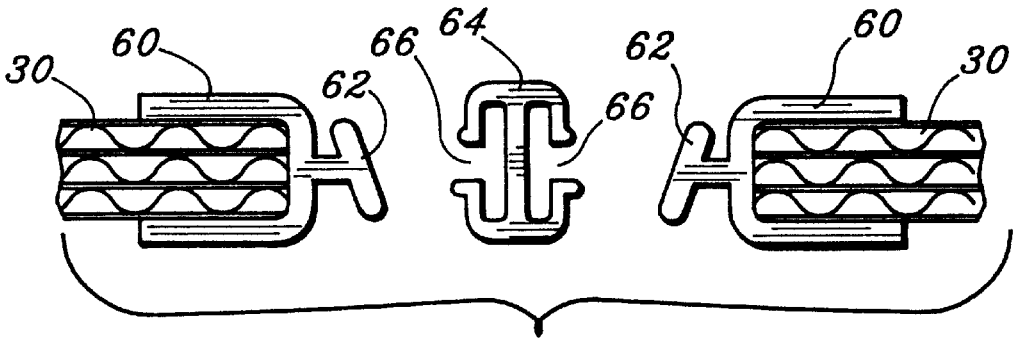
FIG. 5 is a greatly enlarged exploded fragmentary view of portions of two roof segments with their extruded edge connectors and a connecting runner prior to being connected.

With their beams assembled and lying against their respective roof segments, neighboring adjacent roof segments 30 are attached together. Specifically, each of the side edges of the triangular roof segment is already provided with a U-shaped runner 60 (FIG. 5) which straddles along the edge of the roof segment. Integrally formed with the U-shaped runner is a T-shaped extension 62, the crosspiece of the T being angled as shown to accommodate the final angled disposition of the roof segments. An extruded "I"-shaped connector piece 64 is formed with a pair of outward C-shaped openings 66. These openings slidingly receive thee crosspieces of the respective extensions 62. In this manner the roof segments 30 are attached one to the other in waterproof fashion along the length thereof as shown FIG. 4, (the final piece 64 being not yet installed in FIG. 4). The installation of the final connector piece 64 will cause the roof to have its pyramidal shape as shown in FIG. 1.

FIG. 4 shows, for illustrative purposes, the beam blanks still attached to the roof segments. In the usual erection of the roof, the individual beam blanks will have been pre-assembled as described in connection with FIGS. 7*a*, 7*b* and 7*c*. The insertion of the connector pieces 64 will bring together the respective roof beams 50.

As shown in FIG. 4, the vertices of the respective roof segments 30 aim at a central point but are truncated as shown in FIG. 4 at 30*a* to provide a square opening with a simple plastic frame 68 inserted. It slidingly receives a polygonal vent 70 which may be provided with a roof 72 of the same shape as the main roof, with overhang on all sides. The vent is open-bottomed and formed with a screened opening 74 on each face. The vent 70 may be slid up or down in the frame 68 to open or close the vent. A hand opening 76 may be provided for manipulating the vent.

In full assembly, the beams 50 form a continuous downward curb which slips down inside the polygonal wall assembly at the upper ends of the walls. If desired or necessary, a plastic snap catch or other mechanical connector may be used to secure the beams 50 to the respective walls. Such a catch is diagramatically shown at 80 in FIG. 2. It may also take the form of a sheet metal connector, or even a threaded fastener penetrating the layers and perpendicular thereto.

A foot 82 may be provided folded in from the walls to give the walls added stability.

As shown in FIG. 2, the outer surface of the walls 12 may be provided with an outward fabric 82 to secure the structure to the ground using tent pegs or rocks R. The fabric such as is sold under the trademark "TYVEK" may also keep rain water and vermin out of the shelter.

Figure 15:
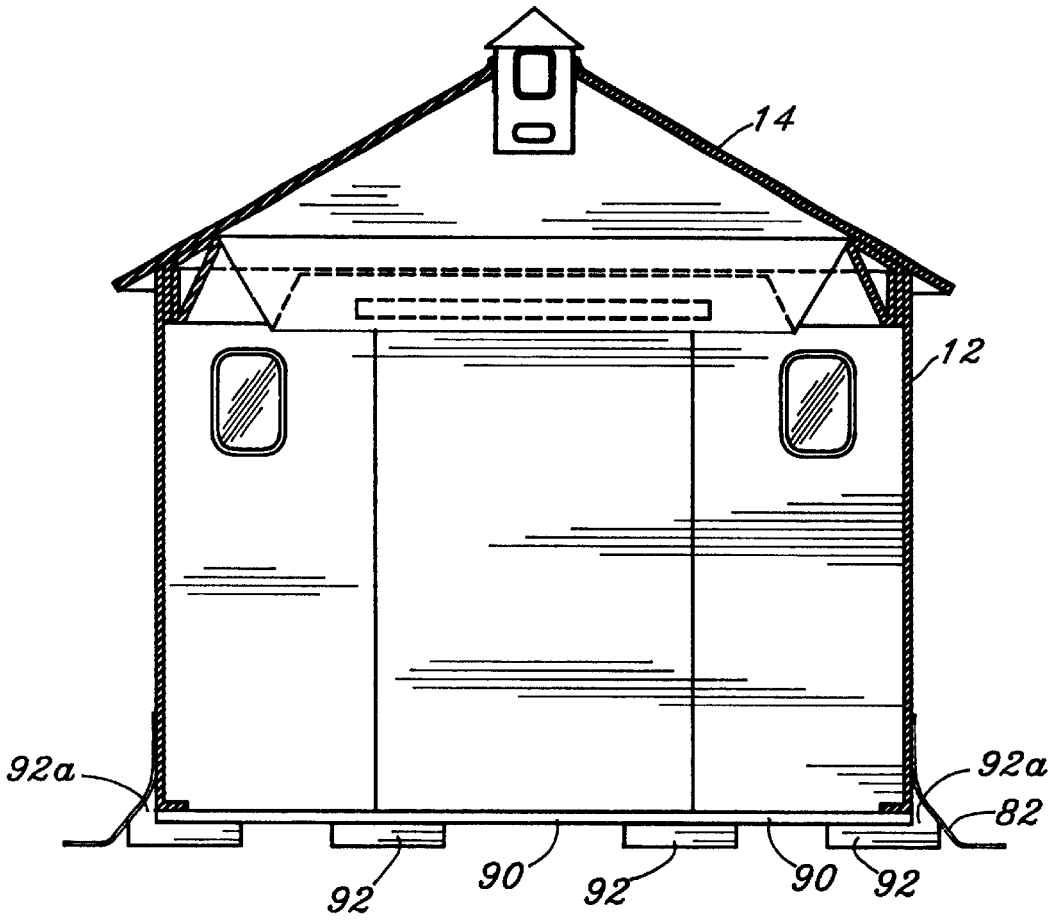
FIG. 15 is a view similar to FIG. 2 also showing the support platforms.
Figure 15A:
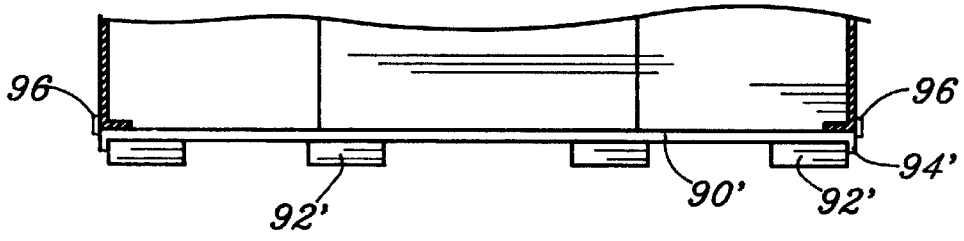
FIG. 15A is a fragmentary view showing an alternate support structure.

Support structure for the shelter is shown in FIGS. 15 and 15A. It comprises in FIG. 15 a platform including a sheet or sheets 90 of plywood or the like, typically 8'×8' which sits on a plurality of spaced parallel elongated blocks 92 of light weight material such as foamed polystyrene. Preferably the material accommodates small unevenness in the ground. The 10 blocks 92 may have upward curbs 92*a* at the outside of the structure to help keep the shelter in place on the sheet

90. The fabric 82 may overlie the curb to keep water from getting between the curb 92 and the shelter.

A variation is shown in FIG. 15A wherein the sheet 90' downturned margins 94' which lap over the outward blocks 92'. A retaining band 96 may encircle the structure to hold it aligned with the sheet.

Variations in the invention are possible. Thus, while t invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. Components for a shelter easily erectable on site comprising:

a. a wall assembly including connected hinged-together panels folded into a compact flat stack adapted in assembly to form a polygonal continuous side wall structure having a plurality of side walls at least some of which comprise adjacent panels, b. a roof assembly comprising a plurality of flat generally triangular roof segments adjacent edges of adjacent segments adapted to be connected and arranged with a vertex of each triangle directed to a central point, the base of each triangular segment being opposite the vertex, the total of the vertices adjacent the point being less than 360° so that the roof, after assembly, comes to a peak toward the point, the roof assembly adapted to superpose the wall assembly with the bases of the triangular roof segments resting on upper ends of the side walls respectively, and c. a plurality of roof attachment and structure reinforcement beams comprising flat sheets having generally trapezoidal shapes with long sides equal to the interior width of the respective walls, each sheet presenting three spaced pre-scored fold lines parallel to the long side and measured different distances from the long side to define from the long side a first, second and third connected side bands and an overlapping end band, each sheet being adapted to be folded on the lines to form a triangular tube, the overlapping band secured to the inside of the first side band, the first and second side bands disposed in a cross section of the tube at an angle similar to the angle between a side wall and a contiguous roof segment and the second side band being adhesively disposed against the roof segment.

2. Components as claimed in claim 1 wherein the overlapping band is secured to the first band by an adhesive strip in the form of two-sided adhesive strip, one side of which is secured to one of the bands and the other side of which is covered by a peel strip adapted to be removed prior to erection.

3. Components as claimed in claim 1 wherein the overlapping band is secured to the first band by mechanical means.

4. Components as claimed in claim 1 wherein the connections between roof segments is made by I-shaped connectors having outwardly facing C-shaped openings, each C-shaped opening receiving an edge of a roof segment.

5. A platform for a shelter made from components as claimed in claim 1 comprising a. a base sheet of rigid material having an outside perimeter similar to that of the shelter, b. plurality of elongate blocks of rigid lightweight material disposed in spaced parallel pattern supporting the base sheet, c. means to retain the shelter walls in alignment with the edges of the base sheet.

6. Components as claimed in claim 1 including mechanical means for securing the beams to the walls respectively.

7. Shelter components comprising a plurality of roof segments and side walls, and at least one roof attachment and structure reinforcement beam component comprising a flat sheet having a generally trapezoidal shape with a long side equal to the width of a side wall, the sheet presenting three spaced fold lines parallel to the long side and measured different distances from the long side to define from the long side a first, second and third connected side bands and an overlapping end band, the sheet being adapted to be folded on the lines to form a triangular tube, the overlapping band secured to the inside of the first side band, the first and second side bands being disposed in a cross section of the tube at an angle similar to the angle between a side wall and roof segment and the second side band adhesively disposed against a roof segment.

8. Shelter components as claimed in claim 7 wherein the overlapping band is secured to the first side band by adhesive.

* * * * *